US005873602A

United States Patent [19]

Hernandez

[11] Patent Number: 5,873,602

[45] Date of Patent: Feb. 23, 1999

[54] WRITING PAD WITH PAPER ROLL

[76] Inventor: Carlos Hernandez, 454 E. 10 St., Hialeah, Fla. 33010

[21] Appl. No.: 953,752

[22] Filed: Oct. 17, 1997

[51] Int. Cl.[6] ..... B42D 17/00

[52] U.S. Cl. ..... 281/44; 281/45

[58] Field of Search ..... 281/44, 45; 402/29, 402/28, 4

[56] References Cited

U.S. PATENT DOCUMENTS

| | | | |
|---|---|---|---|
| 2,791,865 | 5/1957 | Iscoe | 281/44 |
| 3,266,819 | 8/1966 | Hutt | 281/44 |
| 5,174,607 | 12/1992 | Hill | 281/44 X |
| 5,531,481 | 7/1996 | Wiltshine | 281/44 |

*Primary Examiner*—Willmon Fridie, Jr.
*Attorney, Agent, or Firm*—J. Sanchelima

[57] ABSTRACT

A pad to be used with a continuous web, such as paper, that provides an area where the web is taut and suitable for use, such as writing, drawing or marking with different utensils. The web is stored as a roll inside a paper web roll housing from where it is passed through a first web guiding and feeding assembly that is characterized by permitting it to travel in one direction only. The web is then passed through a slot below the first web guiding and feeding assembly and under the pad housing to another slot from where it is passed upwardly and through a second web guiding and feeding assembly similar to the first one in function. Both assemblies include an elongated member with a longitudinal edge in contact with the web to permit to travel in one direction only.

5 Claims, 3 Drawing Sheets

WRITING PAD WITH PAPER ROLL

BACKGROUND OF THE INVENTION

1. Field of the Invention.

The present invention relates to a pad assembly, and more particularly, to the type that includes a continuous web that provides an area where the web is kept taut suitable for use against a cooperating flat surface.

2. Description of the Related Art.

Many writing pad designs exist nowadays, however, none of them disclose the features of the present invention as claimed herein. The present invention discloses a pad for writing, drawing or making marks with a paper roll assembly affixed thereon that continuously feeds a paper web for a user to write on it and also includes at least one paper feeding assembly to permit the paper web to travel in one direction only. While paper webs are the most popular ones, other materials such as plastic, can also be used. Also, using the web is typically accomplished with a writing utensil. A user writes, draws or otherwise marks the web with symbols. For the purposes of this application, the term "writing" includes writing, drawing or marking.

SUMMARY OF THE INVENTION

It is one of the main objects of this invention to provide a writing pad with a continuous paper web that readily provides a user with an area against a flat surface that can be readily used and the used portion of the web is pulled and subsequently detached.

It is another object of the present invention to provide a writing pad with a continuous paper web fed by a roll assembly rotably mounted on the pad.

It is another object of this invention to provide a writing pad that includes paper web feeding assemblies that allow the paper web to travel through in one direction only and keep it taut to facilitate writing on the paper web.

It is another object of this invention to provide a writing pad that includes a replaceable paper web roll for a user to write on it.

It is still another object of the present invention to provide a writing pad that includes a usable flat surface sufficiently large to permit a user to write on the continuous paper web and this flat surface is preferably slanted with respect to a supporting surface for the writing pad.

It is yet another object of this invention to provide such a writing pad that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
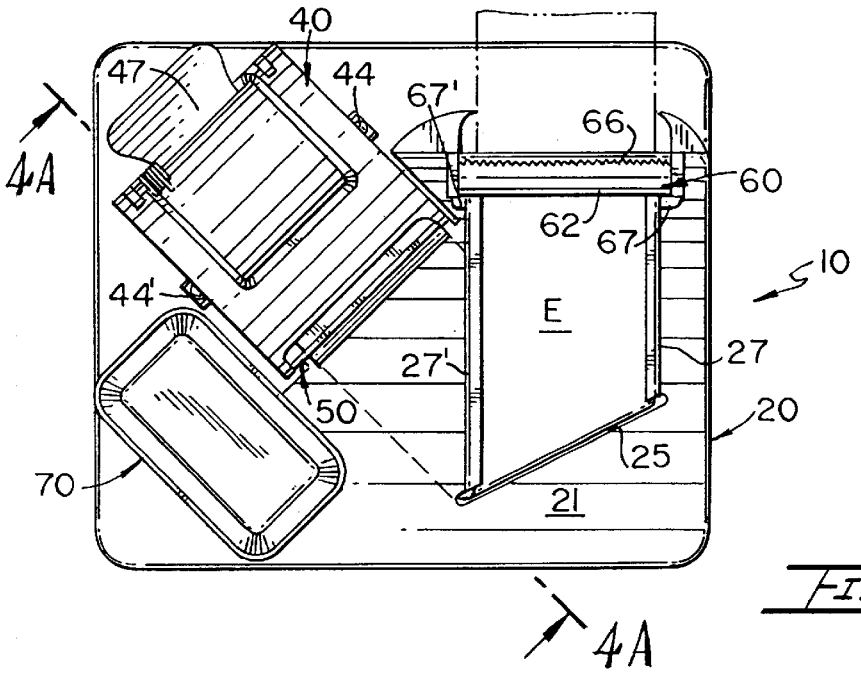
FIG. 1 is a top view of the writing pad assembly incorporating the teachings of the present invention.

Referring now to the drawings, where the present invention is generally referred to with numeral 10, it can be observed that it basically includes pad housing 20 resting on feet members 15, and including upper flat surface 21 which is slanted with respect to bottom plate 22, paper web roll housing assembly 40, paper web feeding and guiding assemblies 50 and 60 mounted to slanted upper surface 21.

Figure 2:
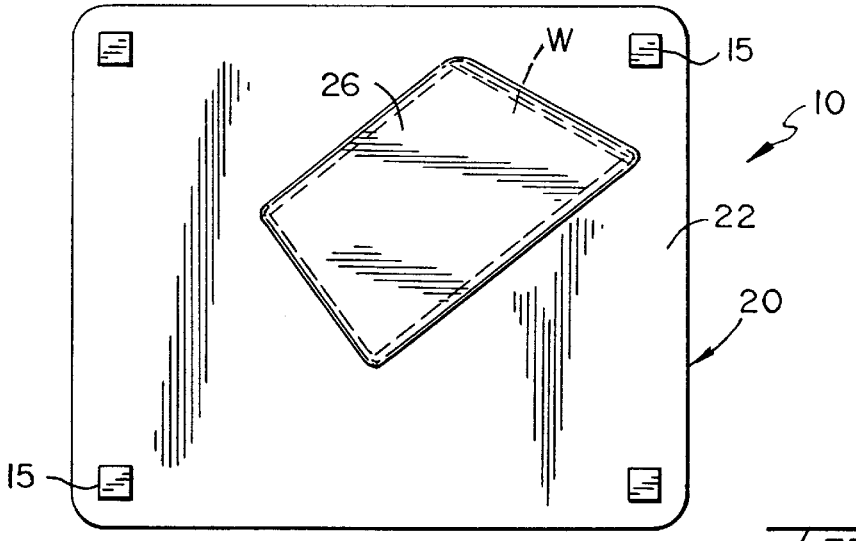
FIG. 2 is the bottom view of the device shown in the previous figure.

As illustrated in FIGS. 1 and 2, pad housing 20 includes elongated slots 24 and 25 through which paper web W is inserted. Slots 24 and 25 are separated from each other and they keep an angle of approximately between 40 and 50 degrees with respect to each other. Pad housing 20 includes upper surface 21 and bottom plate 22 wherein upper surface 21 is slanted with respect to bottom plate 22 keeping an angle of inclination between 10 and 30 degrees.

Figure 3:
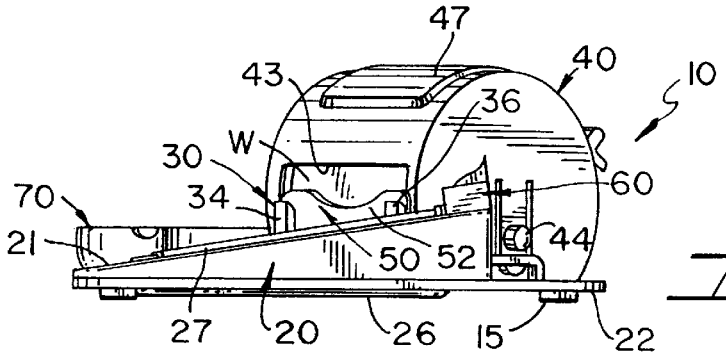
FIG. 3 is an elevational view of one side of this invention.
Figure 4:
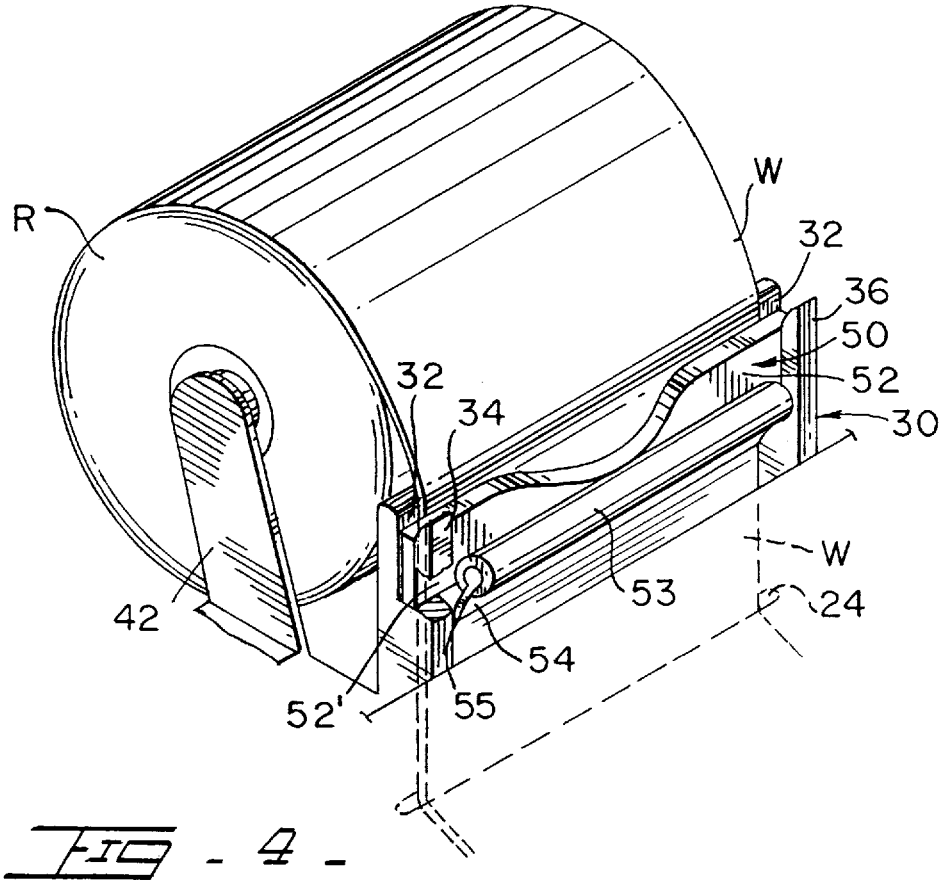
FIG. 4 is an enlarged partial isometric view of the invention showing the paper web passing through a web feeding-guiding assembly.

Paper web roll housing assembly 40, in the preferred embodiment, houses paper web roll R that is removably and rotably supported by holding arms 42, as shown in FIG. 4. Housing assembly 40 has lateral spring loaded pins 44 and 44' that pressing them in permit a user to remove housing 40. Housing assembly 40 includes aperture 43 to allow paper web W to exit through and being inserted through web feeding and guiding assembly 50 as best seen FIGS. 3 and 4. Housing assembly 40, in the preferred embodiment, includes spring biased clip 47 that is mounted on the outer surface of housing 40. Spring biased clip 47 is designed to hold a piece of paper, temporarily freeing up the user's hand.

Figure 4A:
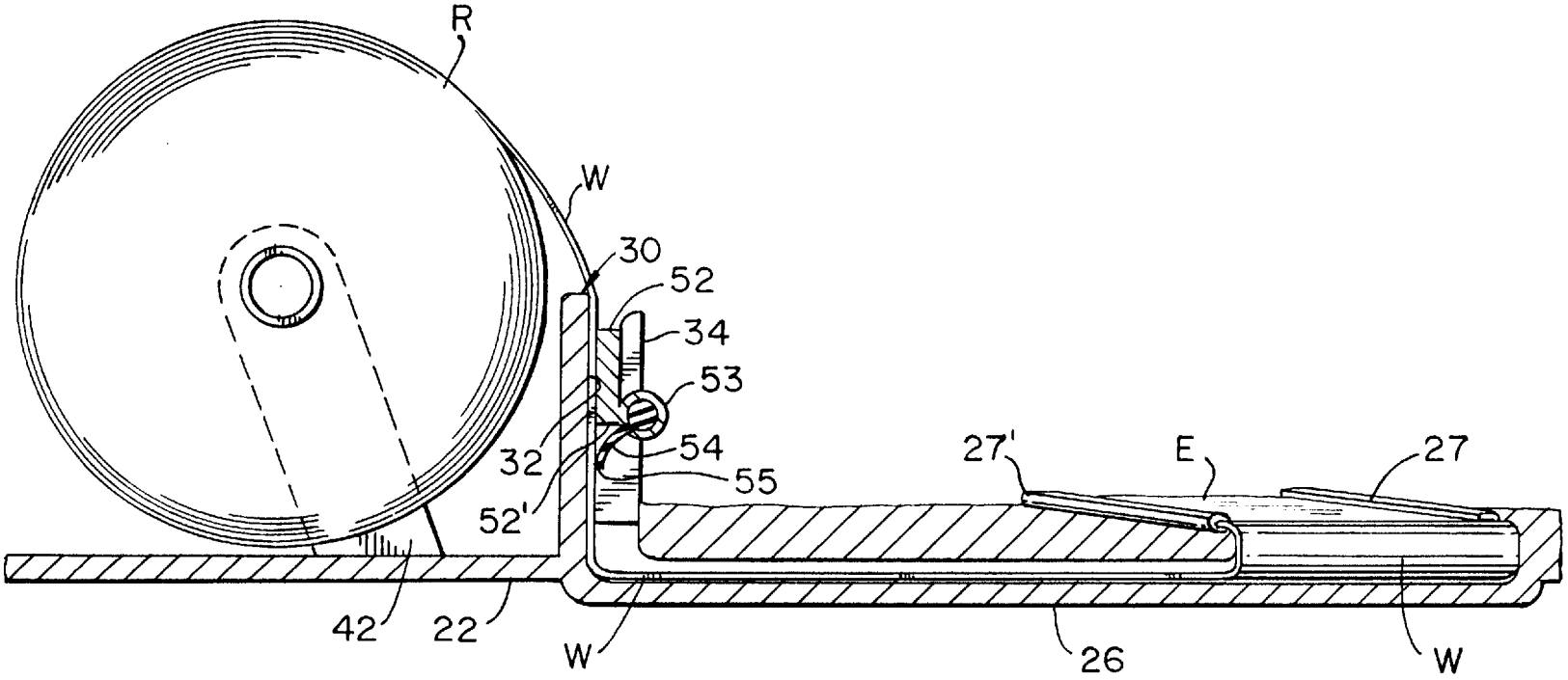
FIG. 4A is an enlarged view of a partial cross section taken along line 4A—4A, showing one of the web feeding-guiding assemblies.

Web feeding and guiding assembly 50, in the preferred embodiment, is mounted on supporting member 30 that in turn is mounted on pad assembly 20. Supporting member 30 has rear wall 32 with stoppers 34 and 36 mounted at a spaced apart relationship with respect each other and wall 32. Stoppers 34 and 36 and wall 32 cooperatively receive assembly 50. Web feeding and guiding assembly 50 basically comprises elongated body 52 with tubular member 53 built-in at the lower edge 52' and extending therealong. Tubular member 53 partially houses elongated flexible and resilient member 54, as shown in FIGS. 4 and 4A. Tubular member 53 includes a longitudinal slot adjacent to edge 52'. In the preferred embodiment, member 54 is made out of rubber since this material is resilient and also has a relatively high frictional coefficient. Other equivalent materials can also be used. As best seen in FIG. 4 A, when web W travels downwardly it is held against wall 32 by flexible member 54 which touches with its outer edge 55 web W at an angle. Member 54 is deflected slightly outwardly as web W travels. If web W attempts to travel in the other direction (upwardly) then member 54 is pushed upwardly in partial compression thus exerting a larger force against web W and frictionally stopping any movement of web W. In this manner, paper web W is kept tight in its path through assembly 50 thereby letting paper web W travel only upon certain pulling force applied from a user in one direction and much more difficult, even if aided by a user, in the other direction. As is illustrated in FIG. 4, the paper web W traveling through web feeding and guiding assembly 50 passes through elongated slot 24 to continue traveling below upper flat surface 21 and above plate 22 and then up through elongated slot 25, as shown in FIG. 1 and 2. Slots 24 and 25 are straight and of sufficient length to permit web W therethrough. Elongated through slot 24 is located below supporting assembly 30. The path of paper web W traveling from slot 24 to slot 25 is protected within depressed portion 26 to avoid interference with web W, as shown in FIGS. 2 and 4. Paper web W then passes through slot 25 to feeding and guiding assembly 60. In this manner, paper web W is bent to the opposite direction with an angle of deflection between 30 and 60 degrees with respect to the portion of paper web W that has being fed through slot 24, as illustrated in FIGS. 1 and 4A.

As illustrated in FIG. 1, exposed writing portion E of paper web W is guided and kept in place by lateral guiding members 27 and 27'. Web feeding and guiding assembly 60, like web feeding and guiding assembly 50 previously described, is designed to keep paper web W taut over a writing space that is defined over slanted upper surface 21 of pad assembly 20. With this purpose, assembly 60 includes elongated rigid body 62 with flexible elongated member 64 mounted therein.

Figure 5:
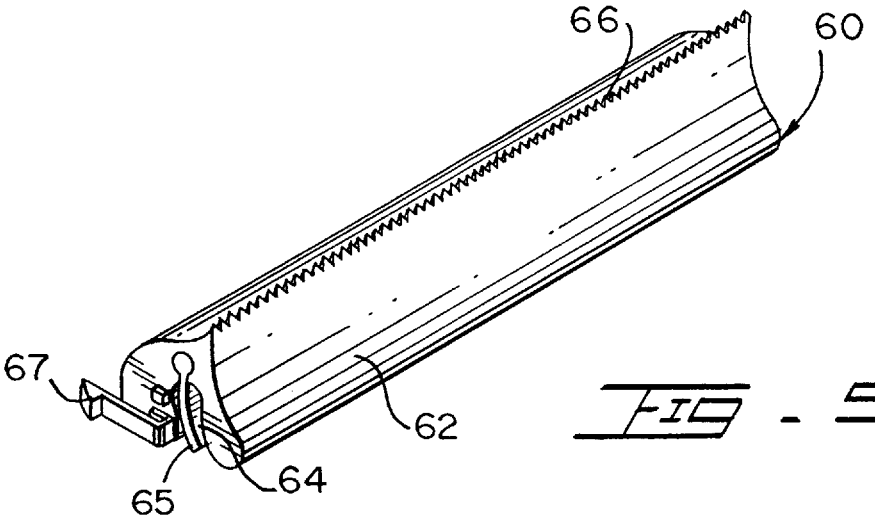
FIG. 5 is an enlarged isometric view of another feeding-guiding assembly for the paper web, that is present in the preferred embodiment.

Paper web W traveling through web feeding and guiding assembly 60 is retained by certain force applied by the outer edge 65 of flexible member 64. In this manner, the exposed writing portion E is kept taut and permits a user to write on it with comfort. The used portion of paper web W is pulled through and cut off by bringing it over cutting edge 66. Cutting edge 66 includes a plurality of teeth upwardly extending, as best seen in FIG. 5. Web feeding and guiding assembly 60 includes also latching members 67 and 67' rigidly mounted on both sides of body 62. Latching members 67 and 67' are designed to remove assembly 60 by applying a force inwardly when a user needs to replace paper roll R.

Pad assembly 20, in the preferred embodiment, has built-in tray 70 mounted to the upper surface of plate 22 and is designed to hold different objects such as, writing utensils, coins, etc.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pad to be used with a continuous web comprising:

A) first housing means including a flat surface with first and second elongated slots, spaced apart and at an angle between 40 and 50 degrees with respect to each other;

B) first web guiding and feeding means mounted on said flat surface above said first elongated slot, and including means for advancing said web in one direction only;

C) second web guiding and feeding means mounted on said flat surface said second elongated slot positioned at a parallel and spaced apart relationship with respect to said second elongated slot means so that an area is defined inbetween, and including means for advancing said web in one direction only; and D) second housing means mounted on said flat surface for storing a roll of said continuous web, and further including a cooperating opening through which said web passes and continues through said first web guiding and feeding means, downwardly through said first elongated slot and upwardly through said second elongated slot to continue and pass through said second web guiding and feeding means so that said web is kept taut over said area to facilitate its use with writing utensils.

2. The pad set forth in claim 1, wherein said first housing means includes a bottom plate and said area of said flat surface is slanted with respect to said bottom plate keeping an inclination with respect thereto between 10 and 30 degrees.

3. The pad set forth in claim 2 wherein said first and second web guiding and feeding means include each an elongated rigid body with a flexible elongated member mounted thereon and said flexible elongated member includes an edge that comes in contact with said web at an angle so that said web travels in one direction only upon the application of a predetermined pulling force.

4. The pad set forth in claim 3 wherein said second web guiding and feeding means includes cutting means mounted thereon.

5. The pad set forth in claim 4 wherein said flexible elongated member is made out of rubber.

* * * * *